US005415413A

United States Patent [19]

Morinich

[11] Patent Number: 5,415,413

[45] Date of Patent: May 16, 1995

[54] BOARD GAME APPARATUS AND METHOD OF PLAYING THE SAME

[76] Inventor: Andrew G. Morinich, 917 Ashbourne Rd., Cheltenham, Pa. 19012

[21] Appl. No.: 303,323

[22] Filed: Sep. 9, 1994

[51] Int. Cl.[6] ..... A63F 3/00

[52] U.S. Cl. ..... 273/271; 273/264; 273/146

[58] Field of Search ..... 273/271, 269, 264, 146, 273/246

[56] References Cited

U.S. PATENT DOCUMENTS 682,388 9/1901 Pigueron ..... 273/271
1,760,642 5/1930 Graham ..... 273/271
3,441,280 4/1969 Eggermont ..... 273/271

*Primary Examiner*—Benjamin H. Layno
*Attorney, Agent, or Firm*—Gary A. Hecht

[57] ABSTRACT

An apparatus and method of play for a board game with a board having spaces defining vertical, horizontal, and diagonal paths. Each player has a set of markers. The object of the game is to complete any one path before the other players by occupying with its markers all the spaces for that path. A directional name indicator randomly selects a players move options each turn. A number selector randomly selects numbers for each player each turn which controls the maximum number of markers that can be added, or other players markers which can be removed, each turn.

15 Claims, 3 Drawing Sheets

BOARD GAME APPARATUS AND METHOD OF PLAYING THE SAME

BACKGROUND OF THE INVENTION

The present invention relates to games of skill and chance. More particularly, the invention relates to board games.

A primary objective of the invention is to provide a game that both children and adults can enjoy. Such a game should be easy to learn so that children can play. To make the game interesting for both children and adults, such a game should involve elements of skill so that a players experience and skill may be advantageous, but also elements of chance so that each play of the game is unpredictable to give the less skilled a chance to win.

SUMMARY OF THE INVENTION

The object of this invention are obtained by a game apparatus having marked spaces defining horizontal, vertical, and diagonal paths. All paths are defined by the same number of spaces. Each player is provided markers which can be placed onto the spaces of the board to indicate that that player occupies that particular space. A directional indicator randomly selects a move option. The move options that can be selected indicate (1) a first move option indicating the player loses a turn, (2) a second move option indicating the player may place its marker on the space, and (3) a third move option indicating a player may place its marker on the space and, in addition, remove markers designating other players. A number selector randomly selects numbers for each player each turn. The number selected for the player whose turn it is indicates the maximum number of markers that that player may place on the spaces that turn for any of the move options. The numbers selected for the other players is the maximum number of markers belonging to these other players that can be removed during that turn when the third move option is selected.

A method of play for the apparatus is also disclosed. One of the above listed move options is randomly selected. A number for each player is also selected. If the first move option is selected, the player loses its turn. If the second move option is selected, the player places its markers onto the space of the board up to a maximum of the number randomly selected for that player. If the third move option is selected, the player places its markers onto the spaces of the board up to the maximum of the number randomly selected for that player, and removes each of the other players markers up to a maximum of the number randomly selected for each other player. The game continues with each player in turn repeating the above steps until a player wins by occupying all spaces of any of the paths.

DESCRIPTION OF THE DRAWINGS

These and other features, aspects, and objectives of the present invention will be better understood with reference to the following description, appended claims, and accompanying drawings for a preferred embodiment of the invention where:

DETAILED DESCRIPTION OF THE INVENTION

Figure 1:
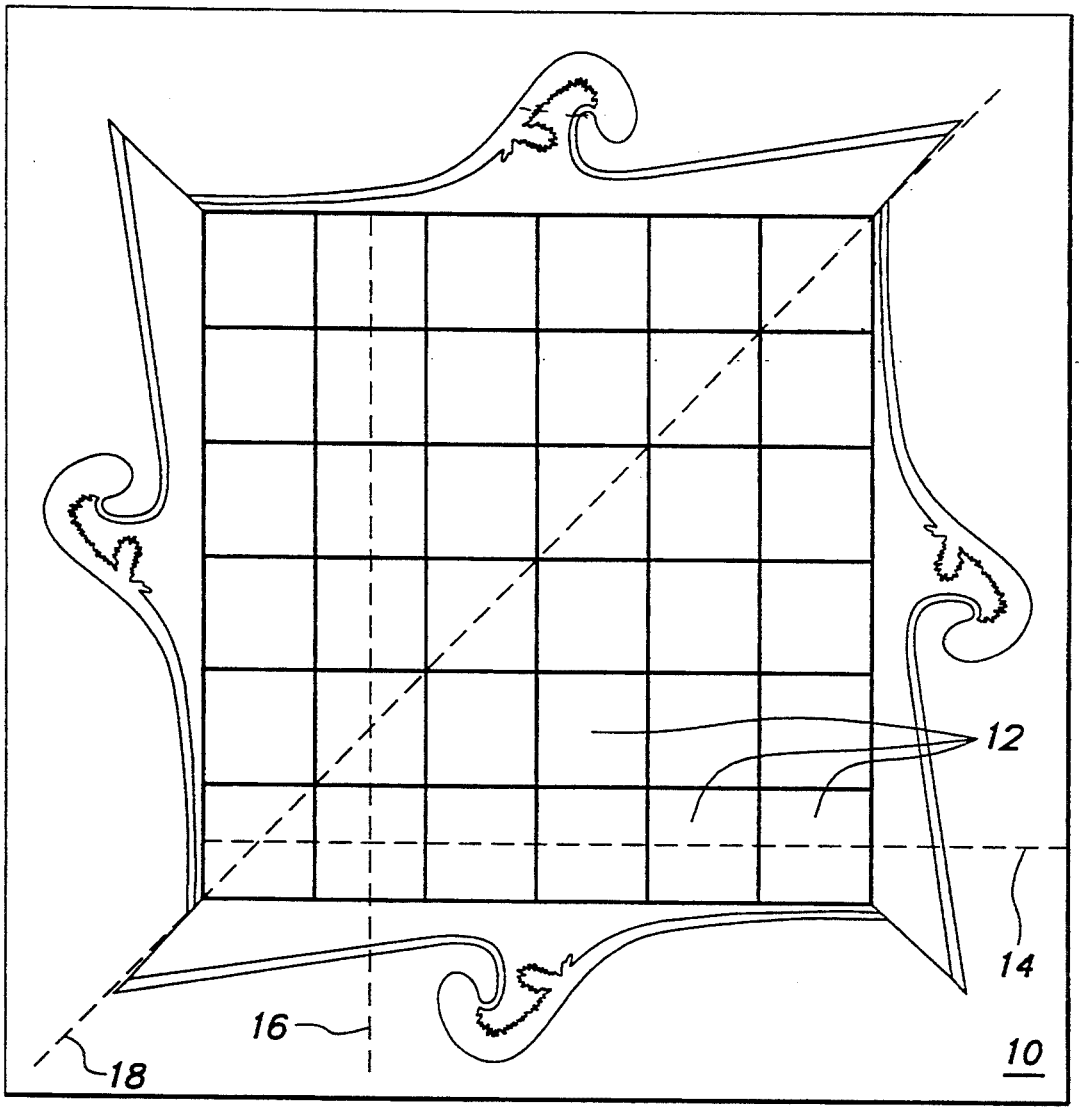
FIG. 1 is a plan view of one form or arrangement of board or playing field for the game.

Referring to FIG. 1, one form of a board 10 for acting as a playing-field for the game of the present invention is illustrated. The board 10 comprises multiple marked spaces 12 defining horizontal paths 14, vertical paths 16, and diagonal paths 18. All such paths contain the same number of spaces 12. In the embodiment shown, all paths contain six spaces.

The players compete to win by placing their markers on the spaces 12 to complete a straight line on any of the horizonal, vertical or diagonal paths. The first to do so is the winner.

Figure 2:
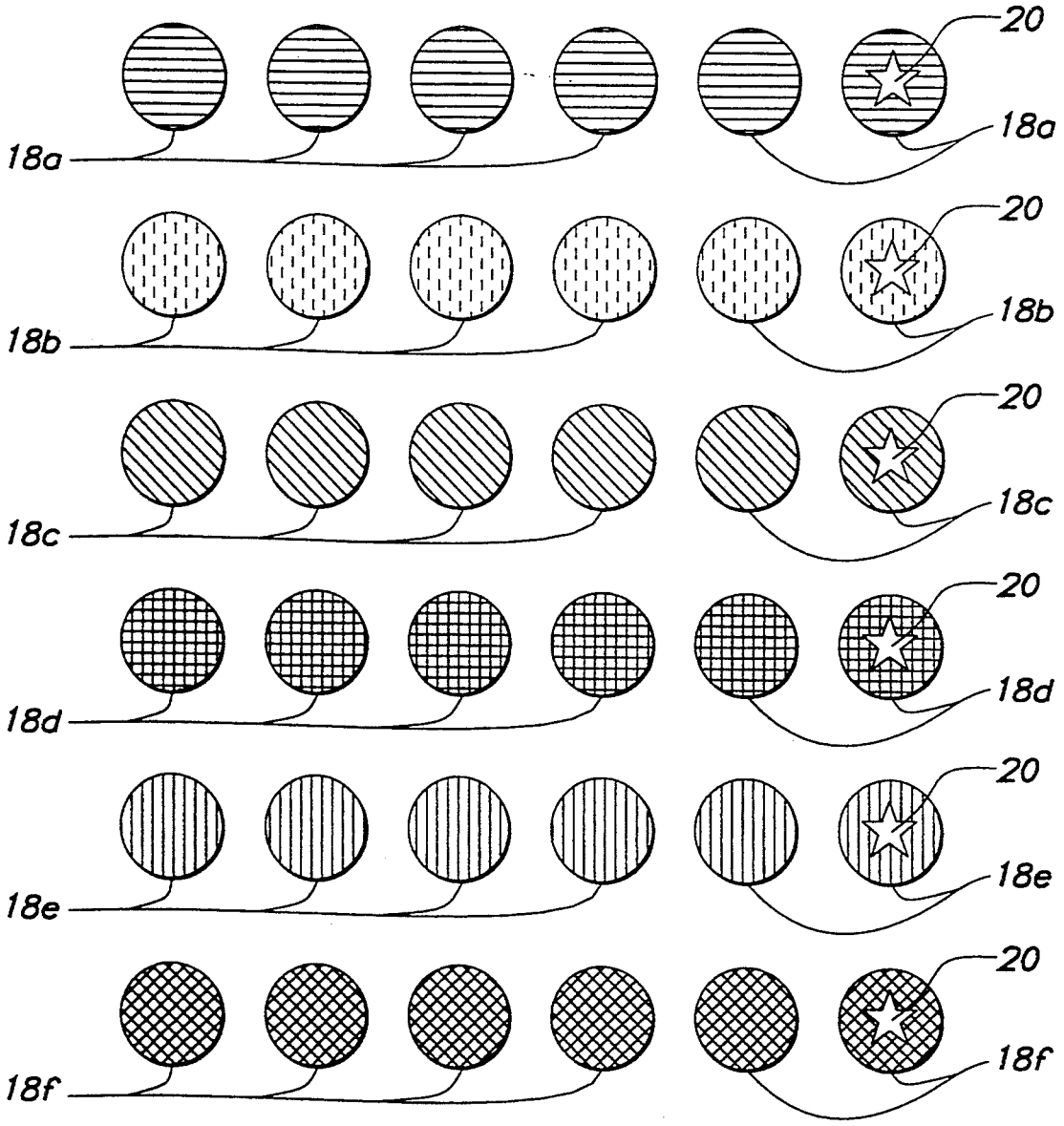
FIG. 2 is a plan view of markers that are used by the players respectively to place on the board of FIG. 1, each set of respective players markers being represented by a distinctive color.
Figure 5:
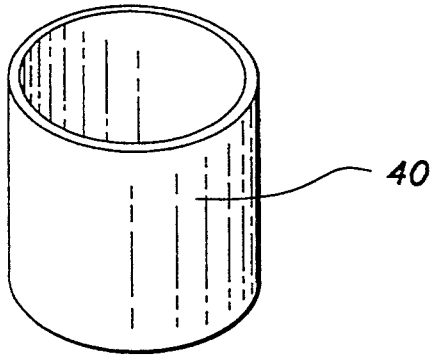
FIG. 5 is a perspective view of a shaker cup.

As shown in FIG. 2, sets of player markers 18*a*, 18*b*, 18*c*, 18*d*, 18*e*, and 18*f* are provided for each player respectively. In the present embodiment, six sets of markers (18*a*–18*f*) are provided as this is the maximum number of players for this embodiment as is more clearly shown below. Each set of markers designates a particular player. A preferred way to distinguish players is with color. By way of example, the markers 18*a* are all blue, the markers 18*b* purple, the markers 18*c* are green, the markers 18*d* are yellow, the markers 18*e* are red, and the markers 18*f* are orange. At least one of each set of player markers contains a further designation 20 to signify its uniqueness from the other markers for uses to be described below; this designation 20 being a star printed on the top of the marker as shown in the present embodiment.

Figure 3:
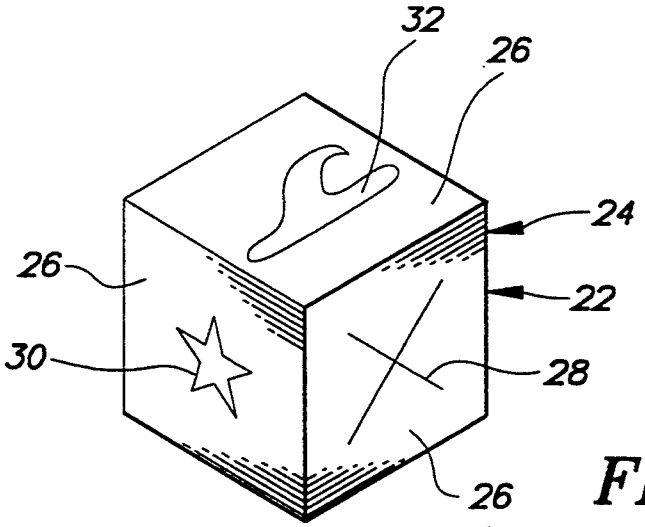
FIG. 3 is a perspective view of a cube used to randomly select a move option.

A directional indicator 22 is used by the player each turn to randomly select a move option for that turn. The move option selected controls the placement of the markers during that turn. In the illustrated embodiment, the directional indicator is a cube 24 as shown in FIG. 3. Each of the cube's faces 26 indicates one of the move options which are randomly selected by rolling the cube 24.

Three move options are provided in the illustrated embodiment. A first move option is designated by a cross 28, a second move option by star 30, and a third move option by a symbol showing a wave 32. The cross 28 (the first move option) indicates that the player loses its turn. The star 30 (the second move option) indicates that the player may place its markers on the spaces 12. The wave 32 (the third move option) indicates that the player may place its markers on the spaces 12 and remove the other players markers from the spaces 12. These options are played as is further described below.

As the cube 24 has six faces, each of the three move options can appear on more than one face 26. In the illustrated embodiment, each move option appears on two faces. These representative designations for the move options are by way of example only as this is how the game was designed as of the time this document was prepared; it is readily understood that the designations for the move options are not limited to the designs herein.

Figure 4:
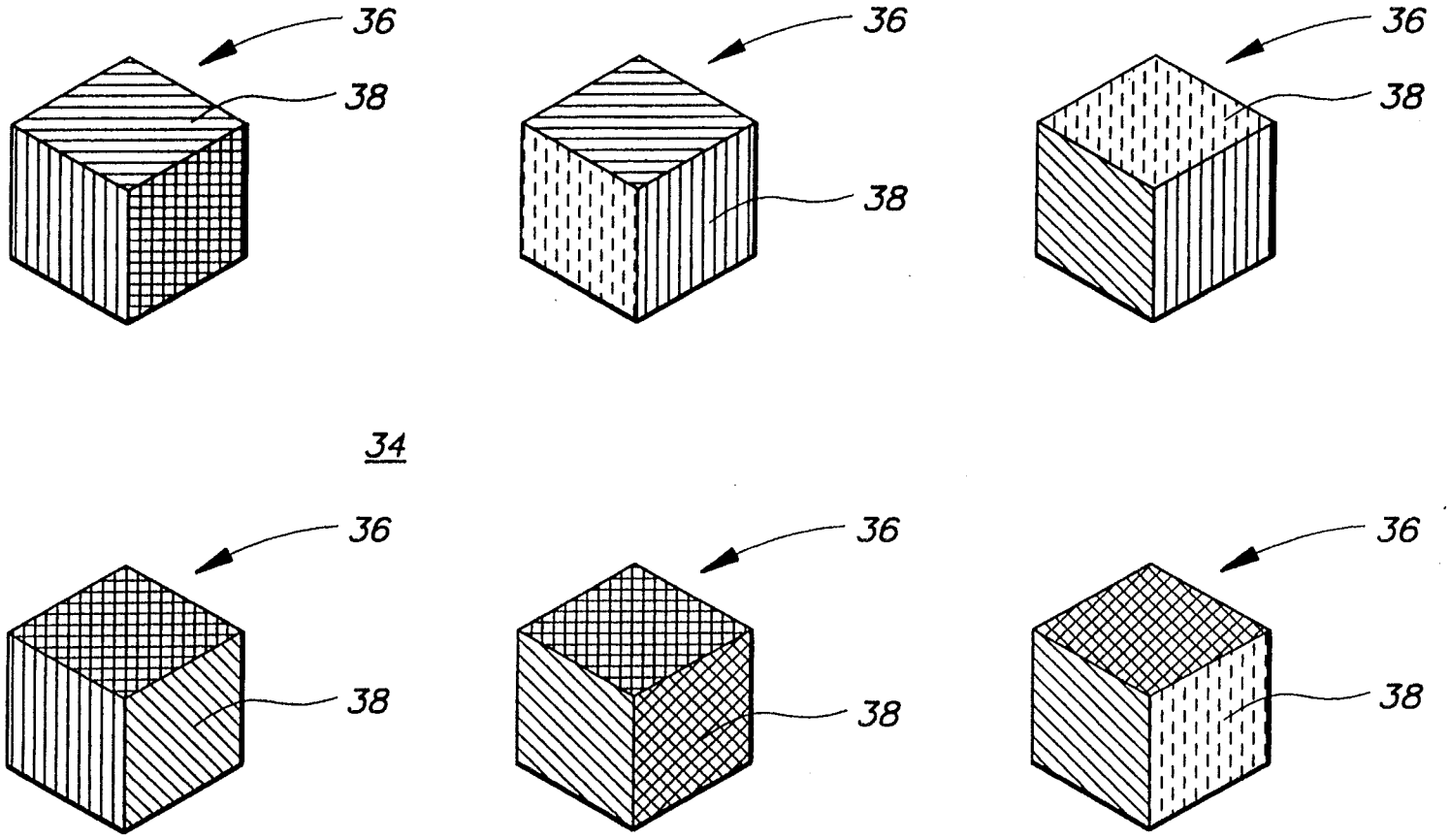
FIG. 4 is a perspective view of cubes for randomly selecting numbers for each player, the cubes being coded with distinctive colors similar to those used for the markers in FIG. 2.

Referring to FIG. 4, a number selector 34 for randomly selecting numbers for each player each turn is illustrated. These numbers determine the number of markers that may be added or removed depending on the move option selected by directional indicator 22.

The number selector 34 preferably comprises color coded cubes 36. In the illustrated embodiment, six such cubes 36, each six sided, are provided. Each face 38 of each cube 36 represents a particular player by matching the color on the markers 18*a*–18*f*. For example, each cube 36 has a blue, a purple, a green, a yellow, a red, and an orange face corresponding with the respective colored markers. As there are six faces 38 per cube, and six players, each player's color appears once on each cube 36.

To randomly select the numbers each turn, all cubes 36 are rolled. The number of cubes 36 showing a particular color on the top face is the number for that player that turn. For example, if two cubes show blue, 3 cubes show orange, and one cube shows green, then the numbers for the players that turn are blue - 2, orange - 3, green - 1, red - 0, purple - 0, and yellow - 0. If all six cubes show red, than the number for the red player is 6, and the number for the other players is 0.

Having described a preferred embodiment of the present invention, a preferred method of play is now described. The players play in turn until one of the players win. To begin, the first player randomly selects a move option with the directional indicator 22 and randomly selects numbers for each player with the number selector 34. In the illustrated embodiment, this is easily completed by placing the directional cube 24 and the color coded cubes 36 in the shaker cup 40 and rolling the cubes from the cup 40. If the cross 28 (first move option) is selected, the player loses its turn and the next player proceeds. If the star (second move option) or wave (third move option) is selected, and the number for the player whose turn it is is 0, then the player also loses its turn.

If the star 30 is selected and the player hasn't lost his turn, the player may place his markers onto the spaces 12. The maximum number of its markers the player can place during any turn being the number selected for that player by the color coded cubes 36 of the number selector 34. For example, if the players color is red and three of the cubes 36 show red, the player may place 3 red markers onto any unoccupied spaces 12 with the goal of completing one of the paths 14, 16 or 18. The star designated marker 20 can be used as a regular marker to cover an unoccupied space 12, or can be used to cover the marker of one of the other players already occupying a space 12. The primary function of the star marker 20 is to be placed on top of an opponents marker. Thus if the red player rolls 4 reds, the player can place three red markers on unoccupied spaces 12, and the star designated red marker 20 on top of another players marker. By doing so, the red player can occupy the space it needs to complete a path, and can also prevent the other player from winning until its marker is no longer covered as described below.

If the wave 32 (third move option) is selected, the player can add its own markers to the board 10 in a similar manner as when the star 30 (move option 2) is selected except that, in the preferred embodiment, the star marker 20 may not be placed with this third move option. In addition, however, the player can also remove other players markers. The number of the other players markers that can be removed is limited by the number of colors indicated by the cubes 36. For example, if the blue player randomly selects the wave designated move option and the color cubes show 2 blue, 2 red, 1 yellow, and 1 green, the blue player may place two of its own markers onto the board 12, and remove up to 2 red, 1 yellow, and 1 green marker. Thus, to remove a star designated marker 20 that is covering its own marker, a player must roll the wave 32 move option and at least one color corresponding to the color of the marker covering its own marker. Removed markers are returned to the players since they are needed to continue with the game.

A player may reposition its markers at any time during the game. For example, If a player has three markers on the board 10 and rolls a star 30 or wave 32 and two of its colors, the player may place 2 more markers on the board 10 or move 2 of the 3 markers already on the board to different spaces 12.

After a player completes its turn, the next player in turn rolls the cubes 24 and 36 to begin its turn. This continues until a player wins.

Changes and modifications in the illustrated embodiment can be made without departing from the scope of the invention which is intended to be limited only by the scope of the appended claims.

What is claimed is:

1. A game apparatus comprising:

a board acting as a playing-field having marked spaces defining horizontal, vertical, and diagonal paths, wherein the number of said spaces defining each said path is the same for all said paths;

player markers designating each player, said markers placeable on said marked spaces of said board thereby indicating which player occupies a particular said space;

a directional indicator for randomly selecting a move option for each turn, said directional indicator comprising:

a first indicia corresponding to a first move option indicating the player loses its turn, a second indicia corresponding to a second move option indicating the player may place its markers on said marked spaces, and a third indicia corresponding to a third move option indicating the player may both place its markers on said marked spaces and remove markers designating other players which are on said marked spaces; and a number selector for randomly selecting numbers for each player each turn, wherein the number selected for the player whose turn it is indicates the maximum number of its markers the player may place on said marked spaces for any said move option, and wherein the numbers selected for said other players is the maximum number of each of those players markers that may be removed when said third move option is selected.

2. A game apparatus in accordance with claim 1 wherein said player markers comprises a set of markers for each player,the number of said markers in each set being the same as said number of spaces defining each said path.

3. A game apparatus in accordance with claim 2 wherein each said set of markers has one marker further designated as a marker that can be placed on a space already occupied by another player.

4. A game apparatus in accordance with claim 3 wherein the number of spaces defining each said path is six.

5. A game apparatus in accordance with claim 3 wherein said directional indicator comprises a cube having faces indicating said first, second and third move options, said move option being randomly selected by rolling said cube.

6. A game apparatus in accordance with claim 5 wherein said number selector comprises rollable cubes for randomly selecting said numbers.

7. A game apparatus in accordance with claim 1 wherein said directional indicator comprises a cube having faces indicating said first, second and third move options, said move option being randomly selected by rolling said cube.

8. A game apparatus in accordance with claim 1 wherein said number selector comprises multiple number cubes which are rolled to randomly select numbers.

9. A game apparatus in accordance with claim 8 wherein the faces of said number cubes indicate a player, and wherein the numbers for each player are randomly selected by rolling said cubes.

10. A game apparatus playable by multiple players playing in turn, said apparatus comprising:

a board having marked spaces defining horizontal, vertical, and diagonal paths, wherein the number of said spaces defining each said path is the same for all said paths;

a plurality of player markers designating each player and being placeable on said spaces of said board to indicate that said space is occupied by the designated player, wherein the number of markers designating each player is at least the number of spaces defining each said path;

a directional cube for randomly selecting one of several move options each turn, said move options comprising:

a first indicia corresponding to a first move option indicating the player loses its turn, a second indicia corresponding to a second move option indicating the player may place its markers on said marked spaces, and a third indicia corresponding to a third move option indicating the player may both place its markers on said marked spaces and remove markers designating other players which are on said marked spaces; and a random number selector for randomly selecting numbers for each player each turn, wherein the number selected for the player whose turn it is indicates the maximum number of its markers the player may place on said marked spaces for any said move option, and wherein the numbers selected for said other players is the maximum number of each of those players markers that may be removed when said third move option is selected.

11. An apparatus in accordance with claim 10 wherein said random number selector comprises multiple second cubes having faces marked to indicate each of the players.

12. An apparatus in accordance with claim 11 wherein at least one of said markers designating each player is further designated as a marker for being placed on a space occupied by another player.

13. An apparatus in accordance with claim 11 wherein said faces of said second cubes are marked with colors to indicate each of the players.

14. A method of playing a board game with multiple players playing in turn comprising the steps of:

(a) providing a playing board having marked spaces defining horizontal, vertical, and diagonal paths, the number of said spaces defining each said path being equal the same for all said paths;

(b) providing markers designating each of the players;

(c) randomly selecting a move option, said move option comprising:

a first move option indicating the player loses its turn, a second move option indicating the player may place its markers on said marked spaces, and a third move option indicating the player may both place its markers on said marked spaces and remove markers designating other players which are on said marked spaces;

(d) randomly selecting a number for each player;

(e) upon selecting said first option in step b, the player loses its turn;

(f) upon selecting the number 0 in step d for the player whose turn it is, the player loses its turn;

(g) upon selecting said second option in step b, the player places its markers onto said spaces up to a maximum of said number selected for that player in step d;

(h) upon selecting said third option in step b, the player places its markers onto said spaces up to a maximum of said number selected for that player in step d, and the player removes the other players markers from said board up to a maximum of said number selected for that player in step d; and (i) repeating the steps c through h for each player in turn until a player wins by occupying all spaces of any said path.

15. A method in accordance with claim 14 further comprising the step of placing a players marker on top of another 2 players marker in steps g and h.

* * * * *

UNITED STATES PATENT AND TRADEMARK OFFICE

CERTIFICATE OF CORRECTION

PATENT NO. : 5,415,413

DATED : May 16, 1995

INVENTOR(S) : Andrew G. Morinich

It is certified that error appears in the above-identified patent and that said Letters Patent is hereby corrected as shown below:

| | |
|---|---|
| Column 1, line 21 | Delete "object" and substitute therefor --objects-- |
| Column 5, line 37 | Delete the second occurrence of "move options" and substitute therefor --directional cube-- |

Signed and Sealed this

First Day of August, 1995

Bruce Lehman

*Attest:*

BRUCE LEHMAN

*Attesting Officer*

*Commissioner of Patents and Trademarks*